US007191544B1

(12) United States Patent
Collins

(10) Patent No.: US 7,191,544 B1
(45) Date of Patent: Mar. 20, 2007

(54) LINT REMOVAL SYSTEM

(76) Inventor: Darlene Collins, 2515 Ocean Crest Blvd., Far Rockaway, NY (US) 11691

( * ) Notice: Subject to any disclaimer, the term of this patent is extended or adjusted under 35 U.S.C. 154(b) by 20 days.

(21) Appl. No.: 11/232,140

(22) Filed: Sep. 22, 2005

(51) Int. Cl.
*F26B 19/00* (2006.01)

(52) U.S. Cl. ..... 34/85; 34/144; 34/146; 34/620; 15/87; 68/5 C

(58) Field of Classification Search ..... 34/85, 34/144, 146, 620; 15/187, 188; 68/5 C, 68/13
See application file for complete search history.

(56) References Cited

U.S. PATENT DOCUMENTS

| | | | | |
|---|---|---|---|---|
| 2,641,296 | A * | 6/1953 | Marco | 156/549 |
| 2,785,557 | A * | 3/1957 | Stilwell, Jr. | 68/12.15 |
| 3,204,271 | A * | 9/1965 | Kingston | 15/1.51 |
| 3,791,055 | A | 2/1974 | Bazelmans et al. | |
| 4,288,934 | A | 9/1981 | Gasser | |
| 4,428,133 | A | 1/1984 | Kamberg | |
| 4,554,752 | A | 11/1985 | Bosshart et al. | |
| 5,036,561 | A | 8/1991 | Calafut | |
| 5,209,244 | A * | 5/1993 | Adkison | 134/6 |
| 5,384,933 | A * | 1/1995 | Wang | 15/311 |
| 6,260,228 | B1 | 7/2001 | Arroyo-Youngblood | |
| 2003/0226636 | A1* | 12/2003 | Anderson et al. | 156/187 |
| 2005/0066457 | A1* | 3/2005 | McKay | 15/23 |

* cited by examiner

*Primary Examiner*—S. Gravini

(57) ABSTRACT

A lint removal system includes a housing that has a top wall, a bottom wall, a front wall, a back wall, a first side wall and a second side wall. Each of the front and back walls has an elongated opening therein. The openings are aligned. A clothes moving apparatus is positioned in the housing and is adapted for moving clothes into the opening in the front wall and outwardly of the opening in the back wall. A plurality of motors is mechanically coupled to the moving apparatus for selectively actuating the moving apparatus. A pair of lint rollers is rotatably mounted in the housing and is positioned adjacent to the back wall. The lint rollers are positioned above and below the opening in the back wall.

10 Claims, 8 Drawing Sheets

LINT REMOVAL SYSTEM

BACKGROUND OF THE INVENTION

1. Field of the Invention

The present invention relates to clothes preparation devices and more particularly pertains to a new clothes preparation device for automatically removing lint from clothing.

2. Description of the Prior Art

The use of clothes preparation devices is known in the prior art. U.S. Pat. No. 3,791,055 describes a device ironing clothing. Another type of clothes preparation device is U.S. Pat. No. 4,554,752 which is again used for ironing clothing. Another ironing device is found in U.S. Pat. No. 4,428,133. While these devices fulfill their respective, particular objectives and requirements, the need remains for a device which may be used for removing lint from an item of clothing.

SUMMARY OF THE INVENTION

The present invention meets the needs presented above by generally comprising a housing that has a top wall, a bottom wall, a front wall, a back wall, a first side wall and a second side wall. Each of the front and back walls has an elongated opening therein. The openings are aligned. A clothes moving apparatus is positioned in the housing and is adapted for moving clothes into the opening in the front wall and outwardly of the opening in the back wall. A plurality of motors is mechanically coupled to the moving apparatus for selectively actuating the moving apparatus. A pair of lint rollers is rotatably mounted in the housing and is positioned adjacent to the back wall. Each of the lint rollers has an axis of rotation that is orientated perpendicular to the first a second side walls. A first of the lint rollers is positioned adjacent to an upper edge of the opening in the back wall and a second of the lint roller is positioned adjacent to the lower edge of the opening in the back wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
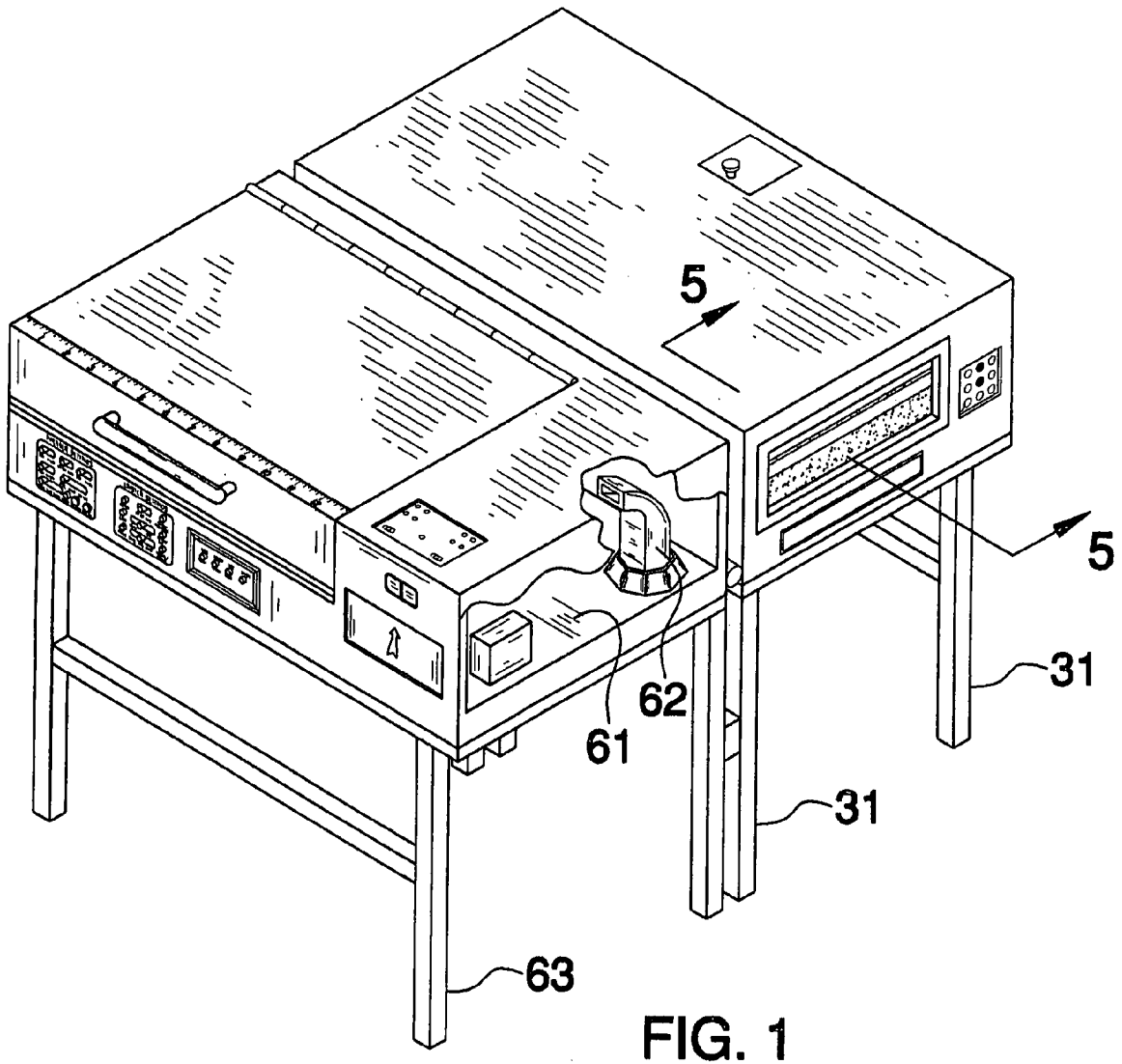
FIG. 1 is a perspective front view of a lint removal system according to the present invention.
Figure 2:
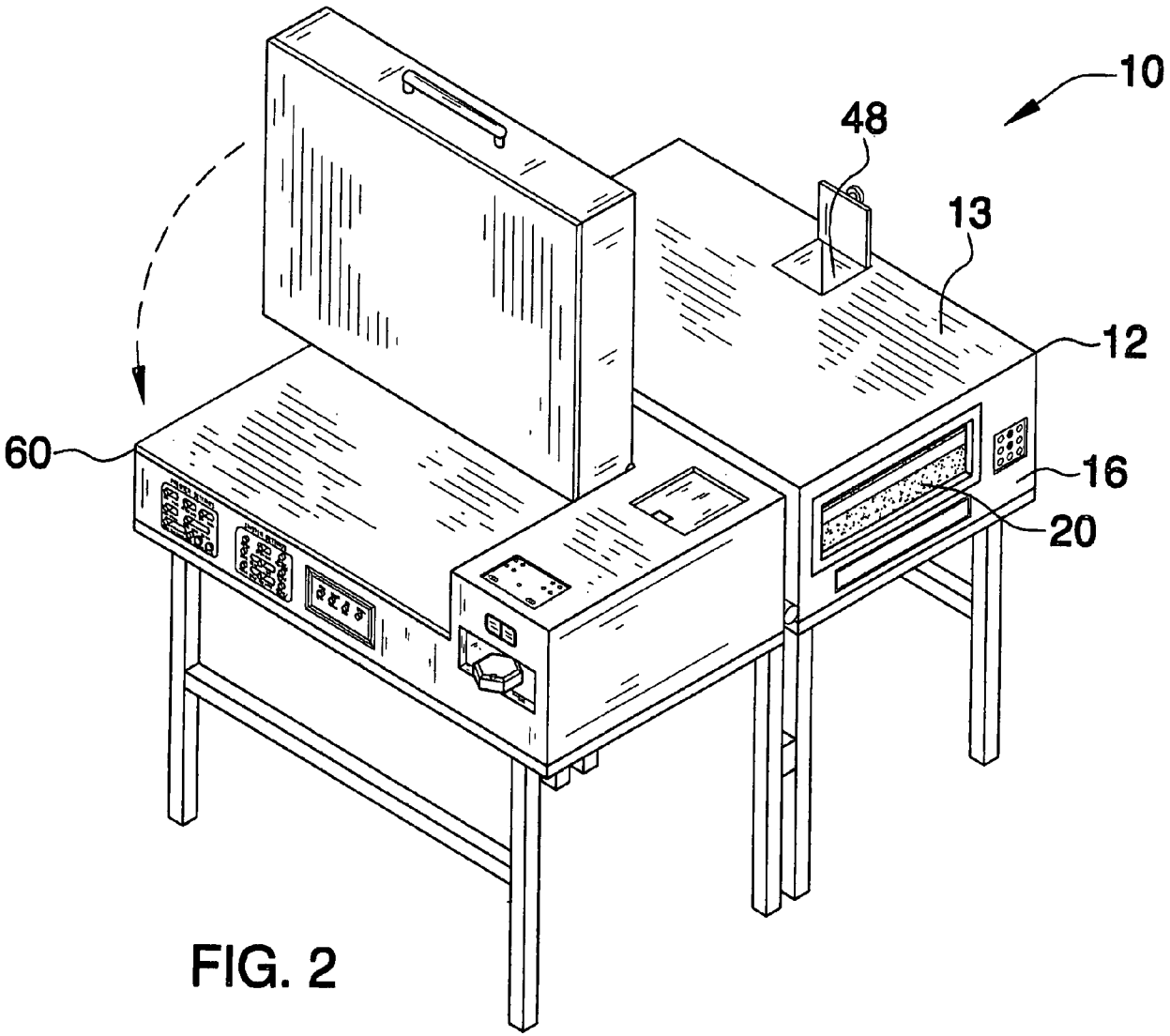
FIG. 2 is a perspective view of the present invention.
Figure 3:
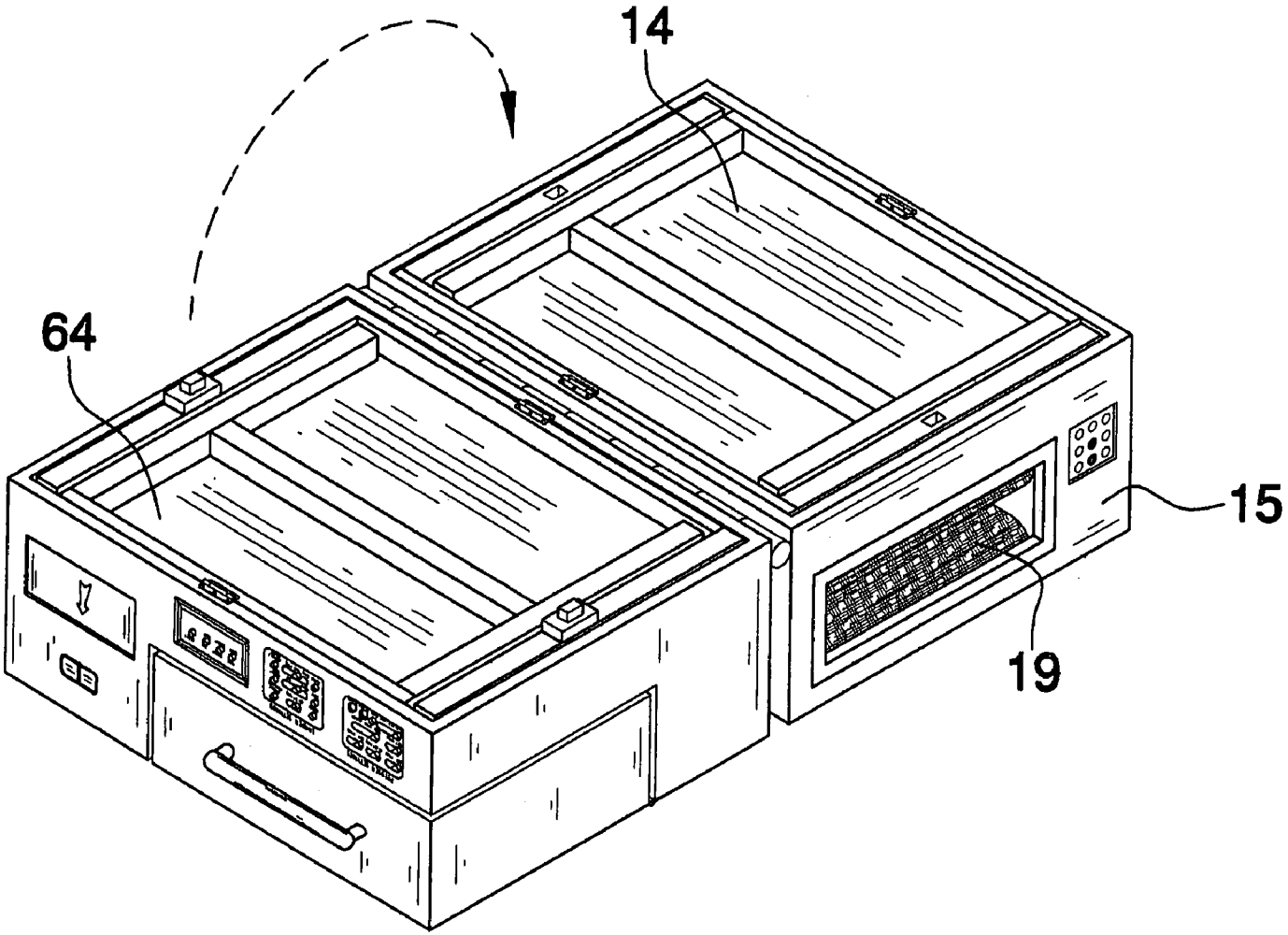
FIG. 3 is a bottom perspective view of the present invention.
Figure 4:
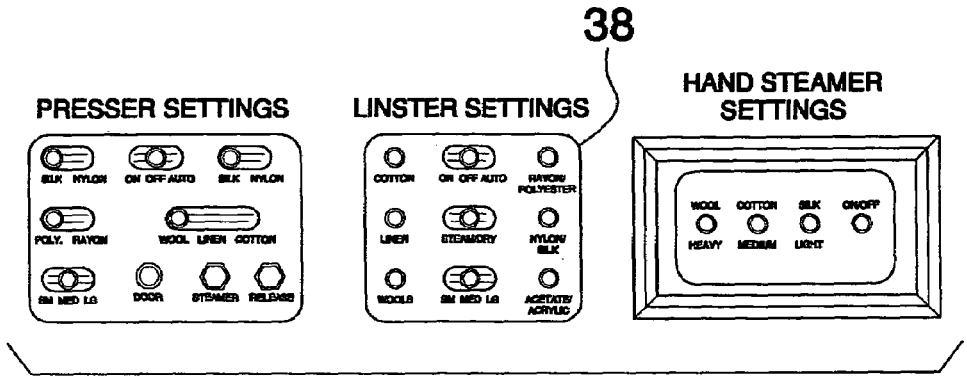
FIG. 4 is a front view of actuators of the present invention.
Figure 5:
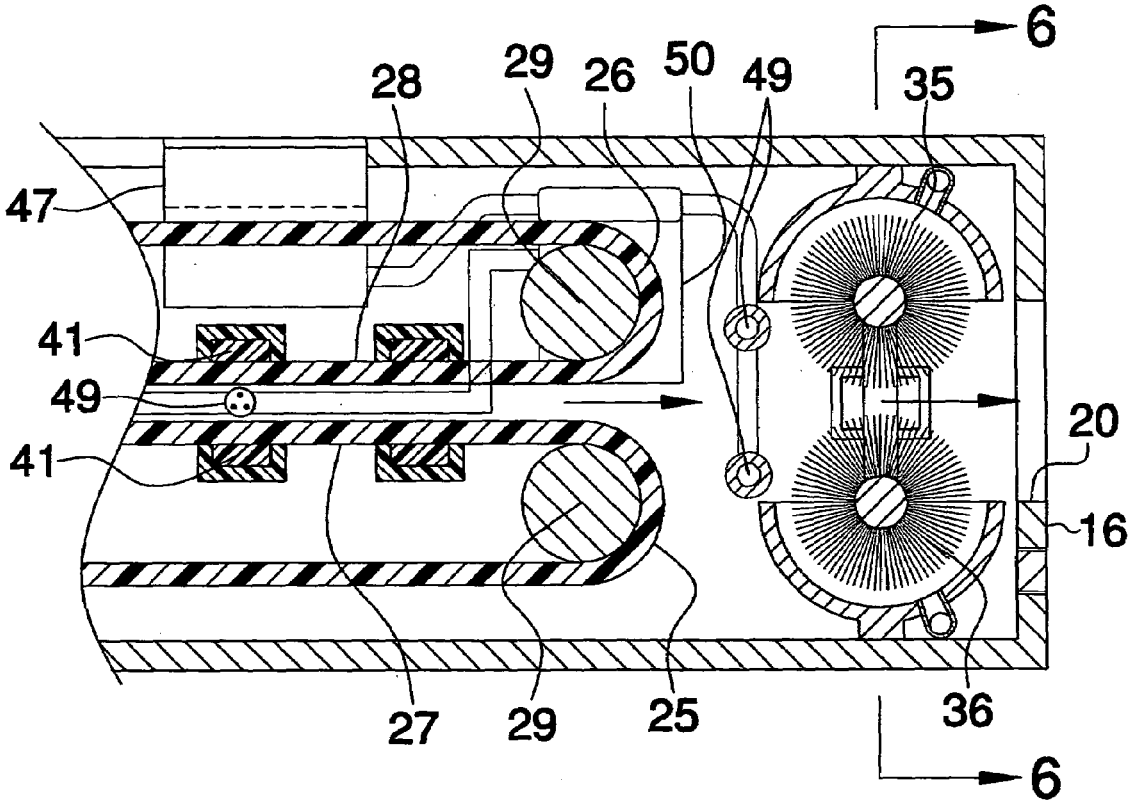
FIG. 5 is a cross-sectional view taken along line 5—5 of FIG. 1 of the present invention.
Figure 6:
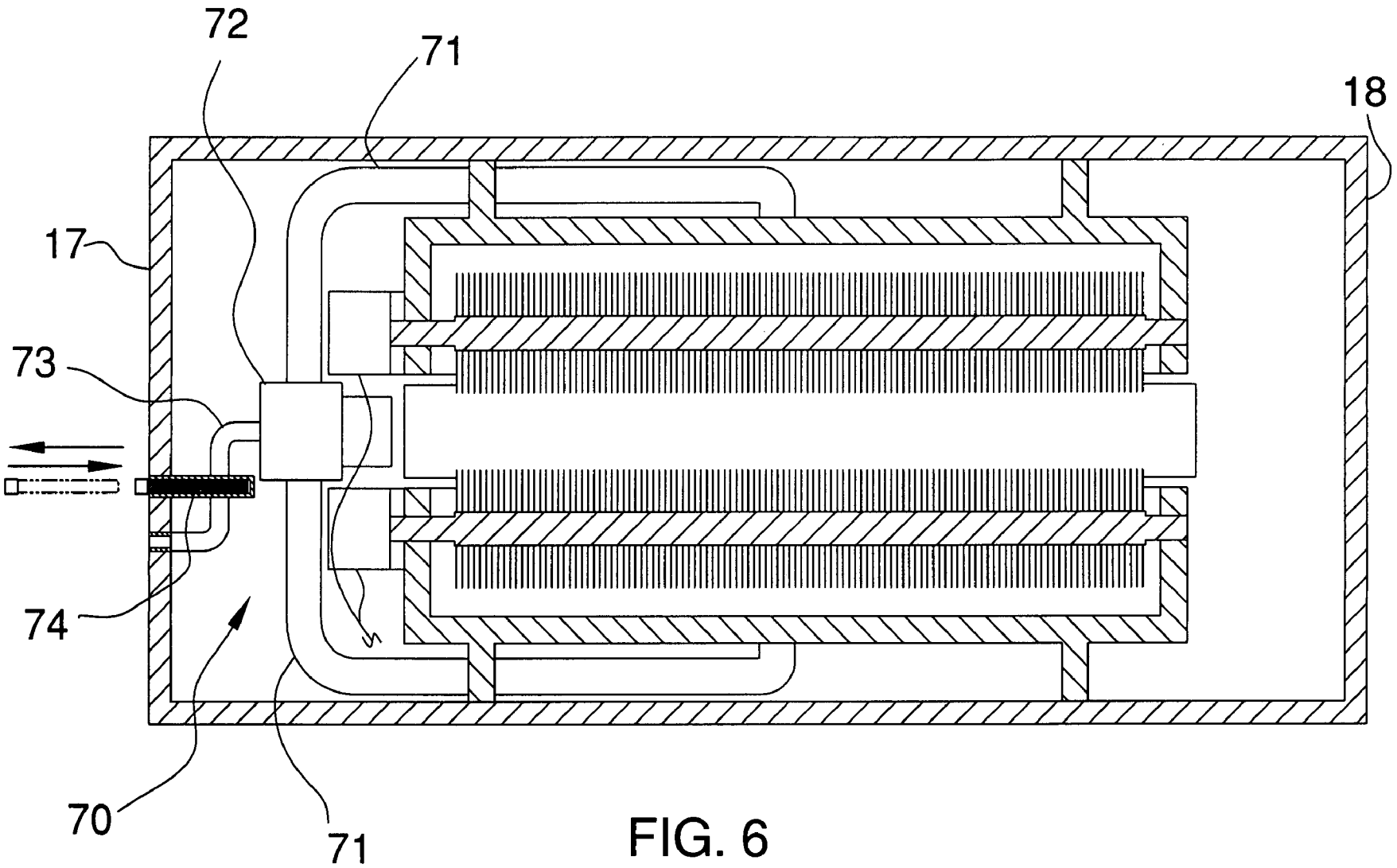
FIG. 6 is a cross-sectional view taken along line 6—6 of FIG. 5 of the present invention.
Figure 7:
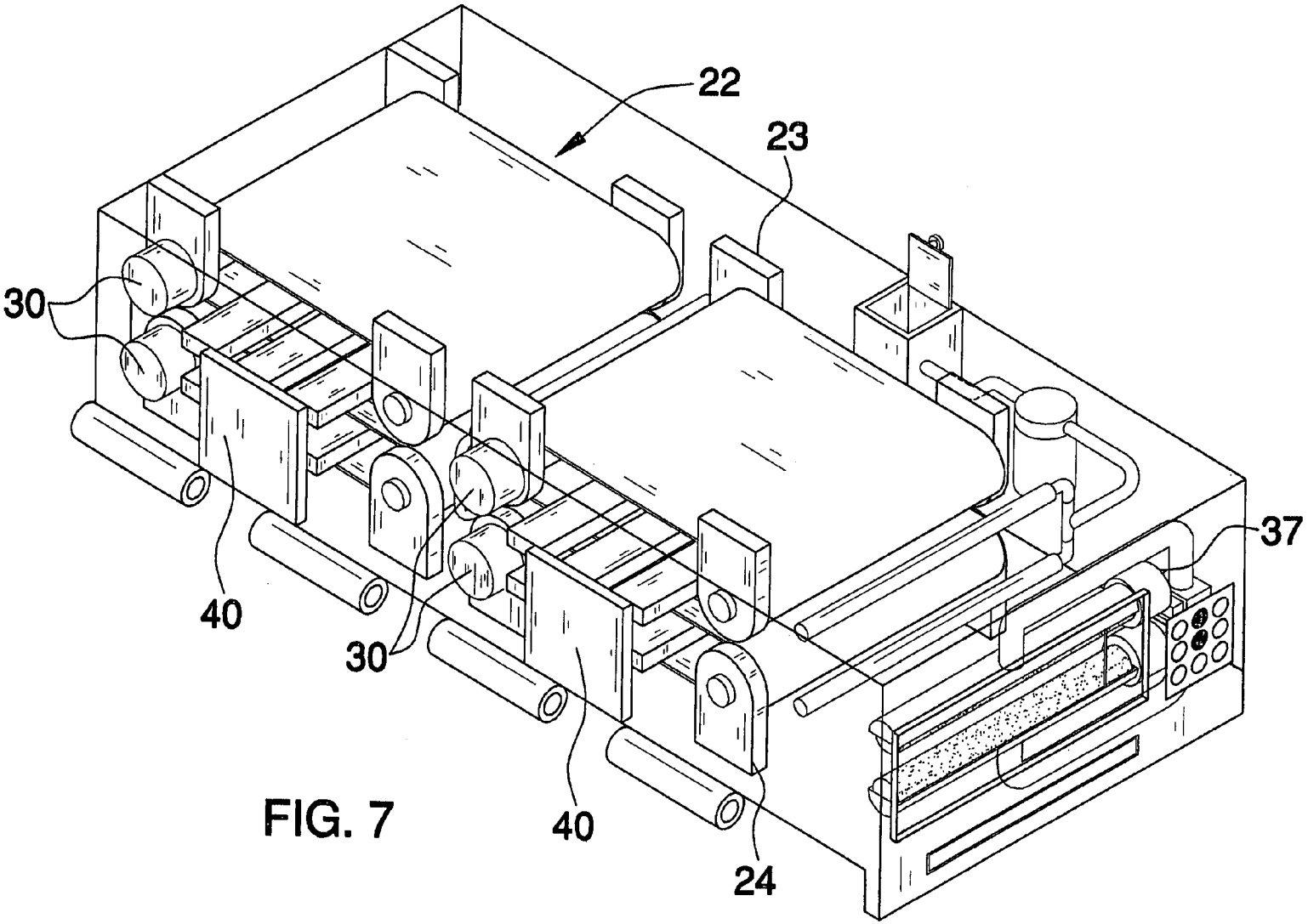
FIG. 7 is a perspective view of an interior of a housing of the present invention.
Figure 8:
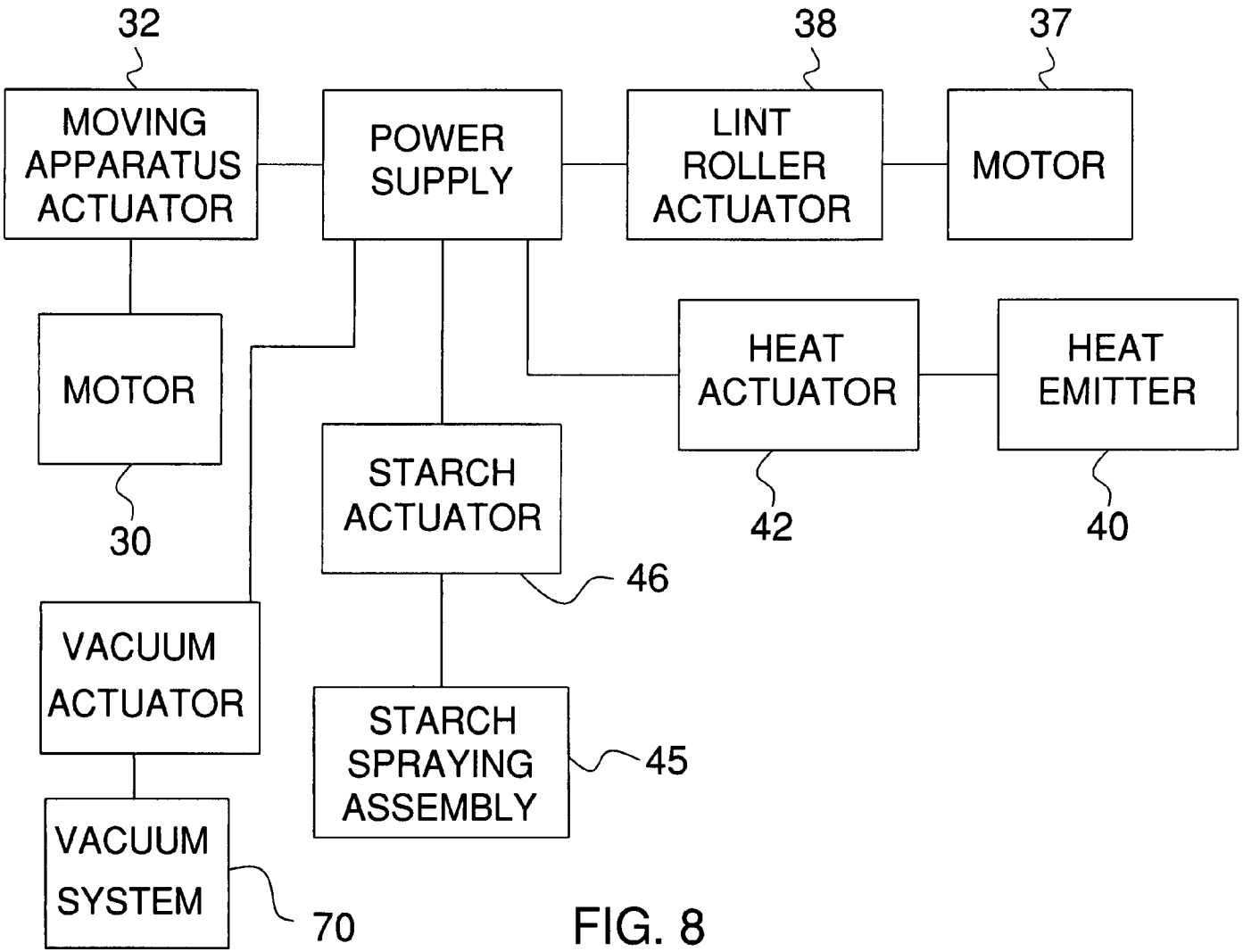
FIG. 8 is an electronic schematic view of the present invention.
Figure 9:
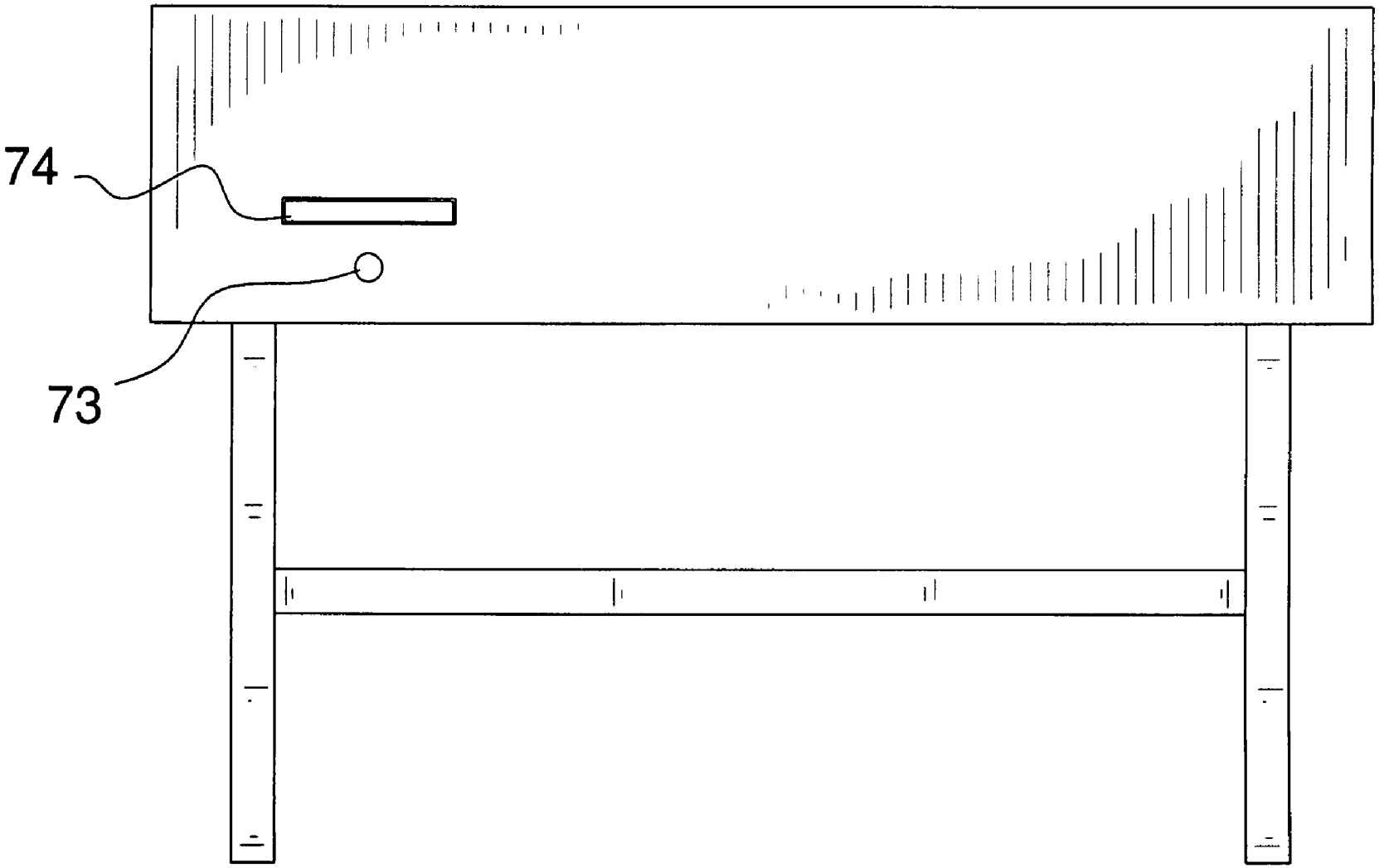
FIG. 9 is a side view of a housing of the present invention.

With reference now to the drawings, and in particular to FIGS. 1 through 9 thereof, a new clothes preparation device embodying the principles and concepts of the present invention and generally designated by the reference numeral 10 will be described.

As best illustrated in FIGS. 1 through 9, the lint removal system 10 generally comprises a housing 12 that has a top wall 13, a bottom wall 14, a front wall 15, a back wall 16, a first side wall 17 and a second side wall 18. Each of the front 15 and back 16 walls has an elongated opening 19, 20 therein. The openings 19, 20 are aligned with each other.

A clothes moving apparatus 22 is positioned in the housing 12 and is adapted for moving clothes into the opening 19 in the front wall 15 and outwardly of the opening 20 in the back wall 16. The moving apparatus 22 includes an upper belt assembly 23 positioned adjacent to the top wall 13 and a lower belt assembly 24 positioned adjacent to the bottom wall 14. An upper portion 27 of a belt 25 of the lower belt assembly 24 is orientated horizontal and parallel to a lower portion 28 of a belt 26 of the upper belt assembly 23. The lower 28 and upper 27 portions are spaced less than 3 inches from each other. The upper 23 and lower 24 belt assemblies may each include a plurality of belts 25, 26 positioned on rollers 29 so that they may rotate within the housing 12. Each of plurality of motors 30 is mechanically coupled to the moving apparatus 22 for selectively actuating the moving apparatus 22. The motors 30 are mechanically coupled to the rollers 29 so that each of the belts 25, 26 may be driven by one of the motors 30. A moving apparatus actuator 32 is electrically coupled to the motors 30 for selectively turning them on or off. A plurality of housing legs 31 is hingedly coupled to the bottom wall 14 of the housing 12. The housing legs 31 are selectively positionable in a stored position abutting the bottom wall 14 or in an extended wall extending downwardly from the bottom wall 14.

A pair of lint rollers 35, 36 is provided. Each of the lint rollers 35, 36 is rotatably mounted in the housing 12 and is positioned adjacent to the back wall 16. Each of the lint rollers 35, 36 has an axis of rotation that is orientated perpendicular to the first 17 a second 18 side walls. A first of the lint rollers 35 is positioned adjacent to an upper edge of the opening 20 in the back wall 16 and a second of the lint roller 36 is positioned adjacent to the lower edge of the opening in 20 the back wall 16. Motors 37 may also be coupled to the lint rollers 35, 36 for aiding in their rotation. A lint roller actuator 38 is electrically coupled to motors 37 for selectively turning the motors 37 on or off.

A plurality of heat emitters 40 is provided. Each of the heat emitters 40 is mounted in the housing 12 and each is adapted for heating the clothes moving apparatus 22. The heat emitters 40 preferably include heating elements 41 positioned within the belts 25, 26 and between the rollers 29 so that the belts 25, 26 are heated. A heat actuator 42 is electrically coupled to the heat emitters 40 for selectively turning the heat emitters 40 on or off.

A starch spraying assembly 45 is mounted in the housing 12 and is adapted for spraying starch on clothes moving through the housing 12. A starch actuator 46 is electrically coupled to the starch spraying assembly 45 for selectively turning on the starch spraying assembly 45. The starch spraying assembly 45 includes a container 47 mounted in the housing 12 and having an access aperture 48 extending therein and through the top wall 13 for filling the container 47 with starch. A plurality of nozzles 49 is fluidly coupled to a pump 50 which is, in turn, fluidly coupled to the container 47.

A steam table 60 is hingedly coupled to the housing 12. The steam table 60 is generally a conventional steam press in structure and usage. The steam table 60 preferably includes an inner compartment 61 for storing a hand steamer 62 and a charger for the hand steamer 62. Additionally, the inner compartment 61 may be used for storing other articles. A plurality of table legs 63 is hingedly coupled to a bottom surface 64 of the steam table 60. The table legs 63 are selectively positionable in a nonsupport position abutting the bottom surface 64 or in a support position extending downwardly from the bottom surface 64. The bottom surface 64 is selectively positionable against the bottom wall 14 when the table legs 63 are positioned in the nonsupport position and the housing legs 31 are positioned in the stored position.

The system may further include a vacuum apparatus 70 mounted in the housing 12 adjacent to the lint rollers 35, 36. Suction tubes 71 fluidly coupled to an air pump 72 are positioned adjacent to and directed at the lint rollers 35, 36. An exhaust tube 73 is fluidly coupled to the air pump 72 and directs air suctioned into the air pump 72 from the suction tubes 71 outwardly from the housing 12. An air filter 74 is removably mounted in the exhaust tube to catch the line pulled off of the lint rollers 35, 36 by the air pump 72.

In use, clothes may be positioned in the housing 12 and moved therethrough with the moving apparatus 32 so that the clothes are brought between and abutted against the lint rollers 35, 36 and lint is removed during that process. The heat elements 41 may be used for removing any wrinkles in the clothes and the starch applied for use in the housing 12 and for use in the steam table 60. Selector buttons mounted on the housing 12 and steam table 60 are used for actuating the various elements and preferably include graduated settings.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lint removal device comprising:

a housing having a top wall, a bottom wall, a front wall, a back wall, a first side wall and a second side wall, each of said front and back walls having an elongated opening therein, said openings being aligned;

a clothes moving apparatus being positioned in said housing and being adapted for moving clothes into said opening in said front wall and outwardly of said opening in said back wall;

a plurality of motors being mechanically coupled to said moving apparatus for selectively actuating said moving apparatus; and a pair of lint rollers, each of said lint rollers being rotatably mounted in said housing and being positioned adjacent to said back wall, each of said lint rollers having an axis of rotation orientated perpendicular to said first a second side walls, a first of said lint rollers being positioned adjacent to an upper edge of said opening in said back wall and a second of said lint roller being positioned adjacent to said lower edge of said opening in said back wall.

2. The device according to claim 1, wherein said moving apparatus includes an upper belt assembly positioned adjacent to said top wall and a lower belt assembly positioned adjacent to said bottom wall, an upper portion of a belt of said lower belt assembly being orientated horizontal and parallel to a lower portion of a belt of said upper belt assembly, said lower and upper portions being spaced less than 3 inches from each other.

3. The device according to claim 1, further including a plurality of heat emitters, each of said heat emitters being mounted in said housing, said heat emitters being adapted for heating said clothes moving apparatus.

4. The device according to claim 3, further including a heat actuator being electrically coupled to said heat emitters for selectively turning said heat emitters on or off.

5. The device according to claim 1, further including a plurality of housing legs being hingedly coupled to said bottom wall of said housing, said housing legs being selectively positionable in a stored position abutting said bottom wall or in an extended wall extending downwardly from said bottom wall.

6. The device according to claim 1, further including a starch spraying assembly being mounted in said housing and being adapted for spraying starch on clothes moving through said housing.

7. The device according to claim 6, further including a starch actuator being electrically coupled to said starch spraying assembly for selectively turning on said starch spraying assembly.

8. The device according to claim 5, further including a steam table being hingedly coupled to said housing, a plurality of table legs being hingedly coupled to a bottom surface of said steam table, said table legs being selectively positionable in a nonsupport position abutting said bottom surface or in a support position extending downwardly from said bottom surface, said bottom surface being selectively positionable against said bottom wall when said table legs are positioned in said nonsupport position and said housing legs are positioned in said stored position.

9. The device according to claim 1, further including a steam table being hingedly coupled to said housing, said bottom surface being selectively positionable against said bottom wall.

10. A lint removal device comprising:

a housing having a top wall, a bottom wall, a front wall, a back wall, a first side wall and a second side wall, each of said front and back walls having an elongated opening therein, said openings being aligned;

a clothes moving apparatus being positioned in said housing and being adapted for moving clothes into said opening in said front wall and outwardly of said opening in said back wall, said moving apparatus including an upper belt assembly positioned adjacent to said top wall and a lower belt assembly positioned adjacent to said bottom wall, an upper portion of a belt of said lower belt assembly being orientated horizontal and parallel to a lower portion of a belt of said upper belt assembly, said lower and upper portions being spaced less than 3 inches from each other;

a plurality of motors being mechanically coupled to said moving apparatus for selectively actuating said moving apparatus;

a pair of lint rollers, each of said lint rollers being rotatably mounted in said housing and being positioned adjacent to said back wall, each of said lint rollers having an axis of rotation orientated perpendicular to said first a second side walls, a first of said lint rollers being positioned adjacent to an upper edge of said opening in said back wall and a second of said lint roller being positioned adjacent to said lower edge of said opening in said back wall;

a plurality of heat emitters, each of said heat emitters being mounted in said housing, said heat emitters being adapted for heating said clothes moving apparatus;

a heat actuator being electrically coupled to said heat emitters for selectively turning said heat emitters on or off;

a plurality of housing legs being hingedly coupled to said bottom wall of said housing, said housing legs being selectively positionable in a stored position abutting said bottom wall or in an extended wall extending downwardly from said bottom wall;

a starch spraying assembly being mounted in said housing and being adapted for spraying starch on clothes moving through said housing;

a starch actuator being electrically coupled to said starch spraying assembly for selectively turning on said starch spraying assembly; and a steam table being hingedly coupled to said housing, a plurality of table legs being hingedly coupled to a bottom surface of said steam table, said table legs being selectively positionable in a nonsupport position abutting said bottom surface or in a support position extending downwardly from said bottom surface, said bottom surface being selectively positionable against said bottom wall when said table legs are positioned in said nonsupport position and said housing legs are positioned in said stored position.

* * * * *